US009017769B2

(12) United States Patent
Scott

(10) Patent No.: US 9,017,769 B2
(45) Date of Patent: Apr. 28, 2015

(54) METHOD AND APPARATUS FOR APPLYING A COATING TO A SURFACE

(75) Inventor: Hamish Scott, Surrey (GB)

(73) Assignee: Pro-Teq Surfacing (UK) Ltd (GB)

( * ) Notice: Subject to any disclaimer, the term of this patent is extended or adjusted under 35 U.S.C. 154(b) by 84 days.

(21) Appl. No.: 13/515,262

(22) PCT Filed: Oct. 4, 2010

(86) PCT No.: PCT/GB2010/001855

§ 371 (c)(1),
(2), (4) Date: Jun. 11, 2012

(87) PCT Pub. No.: WO2011/073604

PCT Pub. Date: Jun. 23, 2011

(65) Prior Publication Data

US 2012/0251716 A1 Oct. 4, 2012

(30) Foreign Application Priority Data

Dec. 14, 2009 (GB) ..... 0921828.0

(51) Int. Cl.
*B05D 1/02* (2006.01)
*B05D 1/12* (2006.01)
(Continued)

(52) U.S. Cl.
CPC ..... *B05B 7/1495* (2013.01); *B05B 1/005* (2013.01); *B05B 7/0815* (2013.01); *B05B 7/1418* (2013.01); *B05B 7/1613* (2013.01); *B05B 7/2491* (2013.01); *B05B 7/2497* (2013.01); *B05B 7/26* (2013.01); *B05D 1/02* (2013.01); *B05D 1/12* (2013.01); *B05D 1/34* (2013.01); *B05D 2451/00* (2013.01); *E01C 19/21* (2013.01)

(58) Field of Classification Search
None
See application file for complete search history.

(56) References Cited

U.S. PATENT DOCUMENTS 1,881,345 A 10/1932 Beatty et al.
2,433,463 A 12/1947 Lampe
(Continued)

FOREIGN PATENT DOCUMENTS

CA 2097579 12/1993
CA 2193720 6/1998
(Continued)

OTHER PUBLICATIONS

Written Opinion of the International Searching Authority for International Application No. PCT/GB2010/001855, dated May 31, 2011 (6 pgs.).
(Continued)

*Primary Examiner* — Frederick Parker
(74) *Attorney, Agent, or Firm* — Christie, Parker & Hale, LLP

(57) ABSTRACT

A method for applying a coating to a surface includes providing a sprayable liquid binding agent formed of first and second components, pumping the first and second components of the binding agent to a first dispensing device and combining the first and second components in the first dispensing device to form the binding agent. The method further includes spraying the binding agent from the first dispensing device on to a surface to be coated, providing a particulate medium, and spraying the particulate medium from a second dispensing device into the liquid spray of binding agent produced by the first dispensing device. The binding agent may coat the particulate medium and adhere it to the surface to form a coating thereon. An apparatus for performing the method is also described.

12 Claims, 6 Drawing Sheets

(51) Int. Cl.

| | |
|---|---|
| ***B05D 1/34*** | (2006.01) |
| ***B05B 7/14*** | (2006.01) |
| ***B05B 7/26*** | (2006.01) |
| ***E01C 19/21*** | (2006.01) |
| *B05B 1/00* | (2006.01) |
| *B05B 7/08* | (2006.01) |
| *B05B 7/16* | (2006.01) |
| *B05B 7/24* | (2006.01) |

(56) References Cited

U.S. PATENT DOCUMENTS

| | | | | | |
|---|---|---|---|---|---|
| 3,606,154 | A | | 9/1971 | Tufts | |
| 3,617,329 | A | * | 11/1971 | Goff | 427/186 |
| 3,676,198 | A | * | 7/1972 | McGroarty | 427/180 |
| 3,844,485 | A | | 10/1974 | Waggoner | |
| 4,542,040 | A | * | 9/1985 | Nowak | 427/196 |
| 4,856,931 | A | | 8/1989 | Bollag | |
| 5,565,241 | A | * | 10/1996 | Mathias et al. | 427/196 |
| 6,090,438 | A | | 7/2000 | Dixon | |
| 6,214,421 | B1 | | 4/2001 | Pidzarko | |
| 6,319,545 | B1 | | 11/2001 | Laurent | |
| 6,383,560 | B1 | * | 5/2002 | Ledbetter | 427/180 |
| 6,786,674 | B1 | | 9/2004 | Hanks | |
| 2004/0253373 | A1 | * | 12/2004 | Langlois | 427/180 |
| 2005/0202181 | A1 | * | 9/2005 | Grossmann et al. | 427/421.1 |
| 2008/0069647 | A1 | | 3/2008 | Deal et al. | |
| 2009/0326104 | A1 | * | 12/2009 | Malboeuf et al. | 524/66 |

FOREIGN PATENT DOCUMENTS

| | | |
|---|---|---|
| DE | 33 43 212 A1 | 6/1985 |
| GB | 1249157 | 10/1971 |
| GB | 1348339 | 3/1974 |
| GB | 1519884 | 8/1978 |
| GB | 2464023 | 4/2010 |
| JP | 51-127993 | 11/1976 |
| JP | 57-119879 | 7/1982 |
| JP | 59-087135 | 5/1984 |
| JP | 61-029963 | 2/1986 |
| JP | 62-016281 | 1/1987 |
| JP | 62-083074 | 4/1987 |
| JP | 64-072455 | 3/1989 |
| JP | 03-162411 | 7/1991 |
| WO | WO 97/00281 | 1/1997 |
| WO | WO 02/074831 | 9/2002 |
| WO | WO 2009/052290 | 4/2009 |

OTHER PUBLICATIONS

International Search Report for International Application No. PCT/GB2010/001855, dated May 31, 2011 (3 pgs.).

* cited by examiner

METHOD AND APPARATUS FOR APPLYING A COATING TO A SURFACE

CROSS-REFERENCE TO RELATED APPLICATION(S)

This application is a National Phase Patent Application and claims priority to and benefit of International Application Number PCT/GB2010/001855, filed on Oct. 4, 2010, which claims priority to and benefit of British Patent Application Number 0921828.0, filed on Dec. 14, 2009, the entire disclosure of which are incorporated herein by reference.

BACKGROUND

1. Field

The present invention relates to a method and apparatus for applying a coating to a surface, particularly for applying a coating to a floor or wall. The present invention is described herein by way of a practical example as a method and apparatus for applying a coating to the surface of a children's play area. However, it is readily applicable to other uses, for example as a surface coating on paths, bridges, steps, gymnasiums, swimming pools, running tracks, decks 1 in public or industrial buildings or in animal enclosures. In general terms, the present invention is applicable to any surface on which a surface coating which is hard-wearing, weather resistant, shock-absorbing and non-slip would be beneficial.

2. Description of the Related Art

Non-slip, shock-absorbing surfaces are commonly used in children's play areas to cushion the impact of a fall and to reduce the severity of any resulting injury. In general, these surfaces are either bound or unbound.

Unbound surfaces, such as bark chips, rubber granules, or sand, offer a solution with a low initial cost and easy installation. However, such surfaces have inherent disadvantages such as they are easily displaced, can be swallowed, hide sharp objects or animal excrement, do not enable wheelchair access and require regular maintenance and replenishment in order to remain effective.

Bound surfaces are typically formed from a rubber filler held within a binding agent. Although more expensive to install than unbound surfaces, these offer a consistent shock-absorbing performance, are easy to clean, are wheelchair accessible and are not easily displaced. The thickness and surface area of shock-absorbing surface required is determined by the "critical fall height" (CFH), where the CFH is determined by the height of the piece of play equipment under which the shock-absorbing surface is to be installed. Two common examples of bound surfaces currently used in children's play areas are rubber tiles and wetpour systems.

A rubber tiled surface typically comprises a number of rubber tiles, measuring about one square meter, arranged on and affixed to a concrete or other solid base using adhesive. However, the tiles can only be used on level surfaces and after a few years use are subject to wear, degradation and shrinkage. The edges tend to disintegrate, allowing weeds to grow and disrupt the surface further and further damage may be caused by vandalism. The tiles are difficult and thus expensive to remove and replace.

Wetpour systems typically comprise a mixture of rubber crumb and a chemical binder. This is mixed and laid by hand. The resulting coating provides a continuous surface that is hard wearing and shock absorbing. However, since the wetpour composition is mixed by hand, it is difficult to maintain consistency between different batches. Further, the wetpour mixture requires approximately twenty four hours to harden, thus the site must be guarded to prevent vandalism while the mixture is setting. The material is also prone to creep at the edges away from a surrounding curb, allowing weeds to grow and presenting a free edge that is more likely to become damaged or vandalized or to become a trip hazard.

SUMMARY

It is an object of the present invention to provide a method and apparatus for applying a surface coating which addresses the above problems.

The present invention provides a method for applying a coating to a surface, comprising the steps of providing a sprayable liquid binding agent, spraying the binding agent from a first dispensing device on to a surface to be coated, providing a particulate medium, spraying the particulate medium from a second dispensing device into the liquid spray of binding agent produced by the first dispensing device, whereby the binding agent coats the particulate medium and adheres it to the surface to form a coating thereon.

Preferably, the binding agent is formed of first and second components and the method further comprises pumping the first and second components of the binding agent to the first dispensing device and combining the first and second components in the first dispensing device to form the binding agent.

Preferably, each of the first and second components are heated independently of the other to a temperature of 70-80° C.

Preferably, the binding agent is a polyurea, the first component is a polyurea hybrid polyol and the second component is a polyurea hybrid isocyanate.

Preferably, the binding agent is sprayed at a pressure in the range of 500-3500 psi.

Preferably, the particulate medium comprises rubber crumb.

The particulate medium may comprise particulates of between 0.5-5 mm in diameter.

Preferably, the method further comprises applying pressurized, heated air to the surface to be coated to clean and dry the surface before spraying the binding agent and particulate medium.

Preferably, the coating is applied in a wave-like manner to a first area to be coated, allowing the coating to cure, applying pressurized, heated air to the surface to be coated to remove loose particulates, and repeating the steps above to coat a second area adjacent to the first, and to coat subsequent areas thereafter.

Preferably, screens are arranged at the borders of the area to be coated before spraying of the coating.

Shielding may be provided for structures located in the area to be coated to prevent the coating adhering thereto, except for the lowermost portions of the structures.

If desired, coatings of different colors may be applied to different areas of a surface to be coated.

Masks or stencils may be used to apply coating to selected areas of a surface to be coated.

The present invention also provides apparatus for applying a coating to a surface, comprising a reservoir containing a sprayable liquid binding agent, a second reservoir containing a particulate medium, liquid dispensing means operable to withdraw binding agent from the first reservoir and dispense it as a liquid spray, and particulate dispensing means operable to withdraw particulate material from the second reservoir and dispense it in spray form into the spray of liquid binding agent.

Preferably, the first reservoir comprises first and second containers containing first and second components which are combinable to form the binding agent.

Preferably, the liquid dispensing means is operable to withdraw the first and second components from the first and second containers and to combine them to form the binding agent-immediately before spraying.

Preferably, the apparatus further comprises means to heat each of the first and second components independently of the other.

Preferably, the apparatus further comprises a cleaning device operable to spray heated, pressurized air onto a surface to be coated to clean and dry the surface.

The present invention also provides a children's play area provided with a surface coating applied with the method set out above.

BRIEF DESCRIPTION OF THE DRAWINGS

The present invention will now be described in detail, by way of example only, with reference to the accompanying drawings, in which.

DETAILED DESCRIPTION

The various items making up the apparatus of the present invention will now be described, followed by an explanation of how the apparatus is used in the method of the present invention. Broadly, the apparatus consists of means for cleaning and drying a surface to be coated, and means for subsequently applying a coating formed of a binding agent and a particulate medium.

Figure 1:
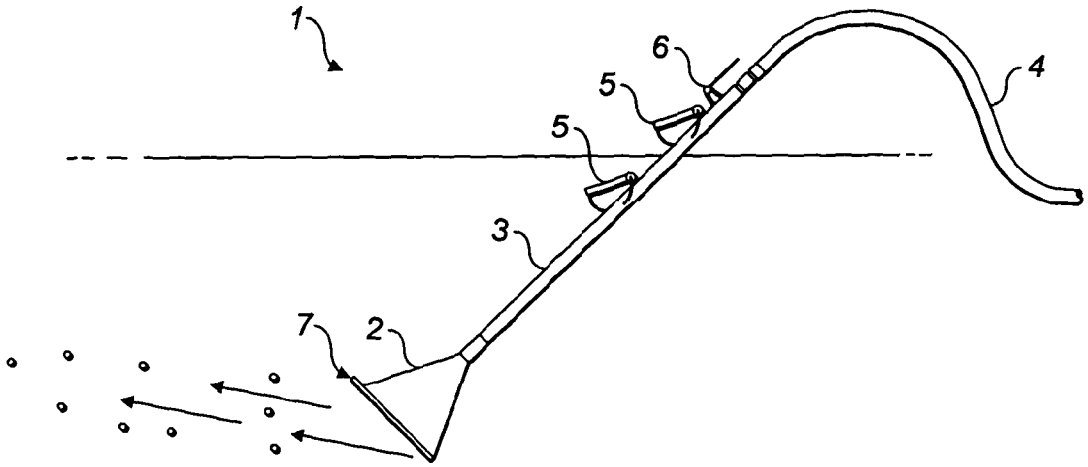
FIG. 1 is a perspective view of an air lance for use with the apparatus in accordance with a first embodiment of the present invention.

With reference to FIG. 1, a typical air lance 1 for cleaning and drying a surface to be coated is shown. The air lance 1 comprises a nozzle 2 and a shaft 3 in fluid communication with a compressor (not shown) by means of a flexible hose 4. The compressor preferably has an after-cooler and a reheater and a free air delivery rating of not less than 240 cubic feet per minute (0.11 $m^3/s$) at 8 bar. The shaft 3 has two handles 5 and an on/off valve 6. In this example, the nozzle 2 is a fishtail nozzle, such that it is flat and tapers outwardly towards the tip. At the tip of the nozzle 2 is an air gap 7. Typically, the flexible hose 4 has an internal diameter of ¾ inches (19 mm) and the air gap 7 has an area of 300 $mm^2$.

Figure 2:
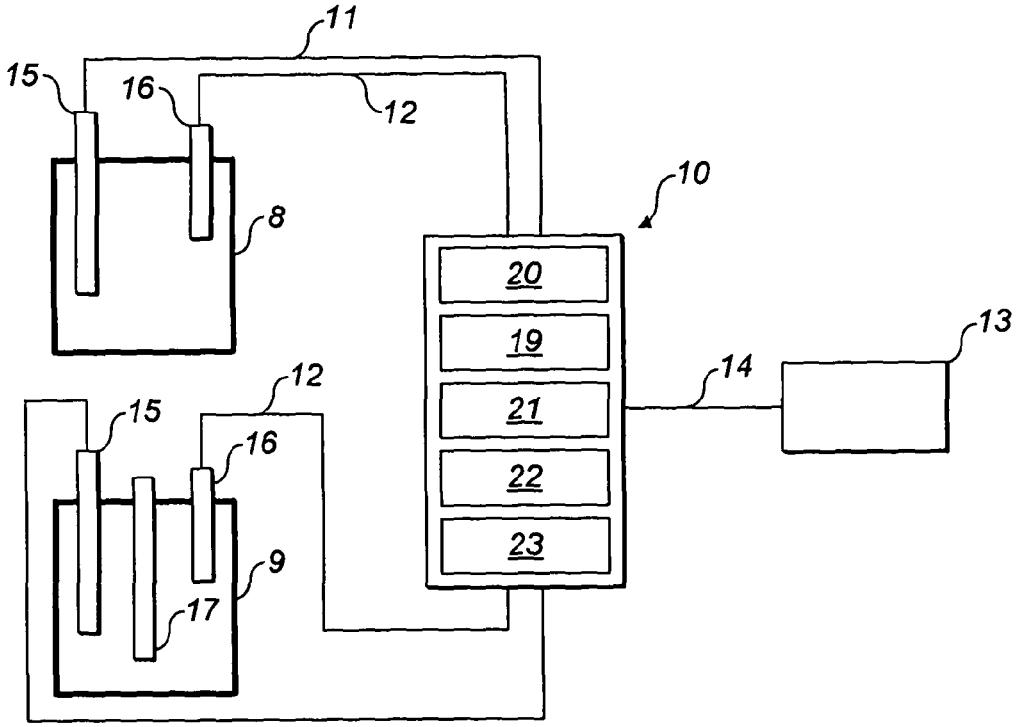
FIG. 2 is a schematic representation of an apparatus for applying a binder component of a surface coating in accordance with a first embodiment of the present invention.

FIG. 2 represents schematically in block diagram form an apparatus suitable for applying, in liquid form, a binding agent of a surface coating. Preferably, a polyurea hybrid binding agent is used, created from a combination of two liquid components. The apparatus includes a first container 8 and a second container 9, whereby the first and second containers 8, 9 contain first and second liquid components of the binding agent, respectively. Both first and second containers 8, 9 are in fluid communication with a plural component proportioning sprayer 10 (such as the "Reactor E-XP2" available from Grace, Inc., Minneapolis, Minn.) via supply hoses 11 and return hoses 12. The sprayer 10 is also in fluid communication with a spray gun 13 (such as the "Plural Component Impingement Mix Air Purge Spray Gun" available from Grace, Inc., Minneapolis, Minn.) via a heated and insulated delivery hose 14 (such as the "Power Lock Heated Delivery Hose" available from Grace, Inc., Minneapolis, Minn.) The spray gun 13 has a nozzle and a mix chamber.

As mentioned above, in this example, a two-part binding agent is used. The two parts, i.e. the first and second components, are kept separate until the point of application and, upon combination, undergo a polymerisation reaction to form a fast curing, highly elastomeric and tough polymer which is resistant to impact, tearing and abrasion. A suitable polymer is a polyurea hybrid formed from the reaction of an isocyanate (such as "Polyurea Hybrid Isocyanate) and a resin blend (such as "Polyurea Hybrid Polyol"). The second component, the "resin blend", may also contain additives, such as an adhesion promoter or UV-stabilizer, pigment, colorant and/or one or more catalysts. Advantageously, the second component includes approximately 5% carbon black in liquid form.

The first and second containers 8, 9 each include a transfer pump 15 (such as a "T111 or "T2" pump available from Graco, Inc. Minneapolis, Minn.) in fluid communication with the inside of the container 8, 9 and connected to supply hoses 11. The containers 8, 9 also include a desiccant dryer 16 to reduce the level of moisture inside the containers 8, 9. The second container 9 is preferably further provided with an agitator 17 (such as a "Twistork™" helix mixer, available from Graco, Inc. Minneapolis, Minn.) to mix the contents of the second container 9.

However, other binding agents such as other sprayable liquid polymers may be used, whether in a two-part form or another form. If a one-part binding agent is used, then only one container and associated hoses etc. will be required.

The sprayer 10 includes a heater 18, comprising separate heater units (not shown), a motor 19, a control panel 20, pumps 21, circulation valves 22 and outlets 23.

Figure 3:
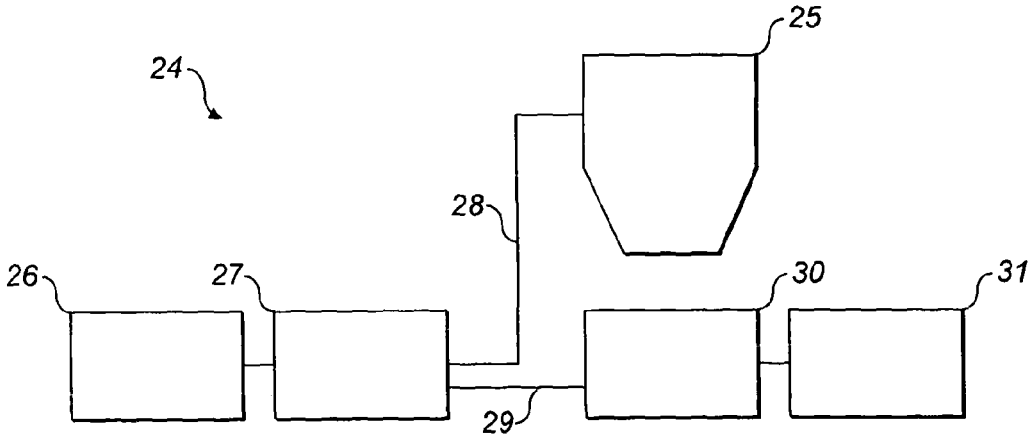
FIG. 3 is a schematic representation of a part of the apparatus for supplying a particulate component of the surface coating.

With reference to FIG. 3, an apparatus for applying particulate media into the binding agent of the surface coating is shown schematically in block diagram form. The particulate media apparatus 24 has a hopper 25 for containing particulate media, a compressed air inlet 26, a regulator 27, a pressure line 28, a blast line 29, a media control valve 30 and a blast outlet 31. In use, a flexible blast hose and a blast nozzle (not shown) are connected to the blast outlet 31 for the application of particulate matter. A suitable apparatus for applying particulate media is the "1448NC Softstrip Portable Multi-media Blast Cleaning Machine", available from Hodge Clemco Ltd. of Sheffield, United Kingdom. The delivery of media is controlled by the user by means of a deadmants handle (such as the "RM21", available from Hodge Clemco Ltd. of Sheffield, United Kingdom) and a slide valve (such as the "RCAMV6", available from Hodge Clemco Ltd. of Sheffield, United Kingdom) disposed toward the blast nozzle end of the blast hose. In this example, the particulate media is rubber crumb, preferably sized between 0.5 mm and 1.5 mm.

However, various other surface grade media may also be applied using the present invention. For example various sizes of particulate matter may be used, ranging from rubber dust to rubber crumb of up to 4 mm in size. Alternatively, for non-slip applications, sand or grit may be used, ranging in size from very fine kiln dried sand to grit of up to 5 mm in size.

Figure 4:
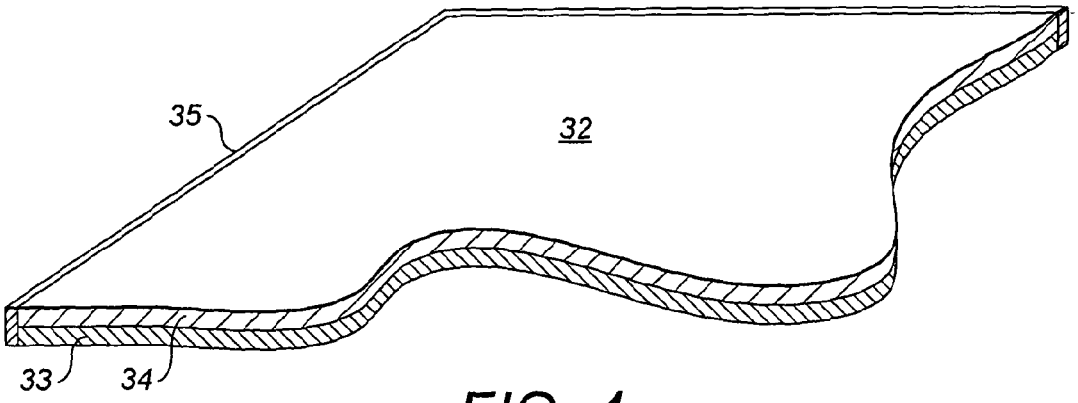
FIG. 4 is a perspective, part sectional view of an area to be coated.

With reference to FIG. 4, a typical surface to be coated 32 is shown. The surface comprises a solid base 33, typically formed of concrete, on which is placed a top surface 34. Typically the top surface 34 is an existing arrangement of rubber tiles or a layer of wetpour in need of repair/replacement, although the surface to be coated 32 might also be an uncoated concrete or tarmacadam surface. The surface to be coated 32 is bordered by a two inch (51 mm) curb, or a pin curb 35.

With reference to FIGS. 5-9, a method of applying a surface coating will now be described.

The air lance 1 is held by the user by handles 5. The on/off valve 6 of the air lance 1 is turned to an "on" position 1 causing the air lance 1 to expel compressed, dehumidified and heated air from the air gap 7 of nozzle 2. By sweeping the nozzle 2 above the surface to be coated 32, preferably with air lance 1 being held such that the air is expelled at an angle of between approximately 30 and 40 degrees to the horizontal, unwanted matter, such as dirt or dust, which may otherwise negatively affect the adhesion of the surface coating can be lifted and removed from the surface to be coated 32, leaving it clean and dry.

Any breaks, holes or gaps in the surface to be coated are then repaired using adhesive and loose rubber crumb or closed cell foam cut into appropriately sized strips, in order to render the entire surface as a flat, level (or cambered) dry area ready to be coated.

If the underlying surface is irreparatively damaged, the binding agent used in the present invention can be applied as an adhesive in order to stick down rubber tiles, for example of 6 mm thickness, to provide a flat even surface for application of the final surface coating.

The curb 35 is coated in a primer, for instance a two part epoxy primer (such as "Conprime", available from Leeson Polyurethanes Ltd. of Warwick, United Kingdom), and coated in a fine layer of kiln dried sand (such as "Chalford 52"). The air lance 1 is used, as described above, to remove loose sand once the primer has hardened.

Figure 5:
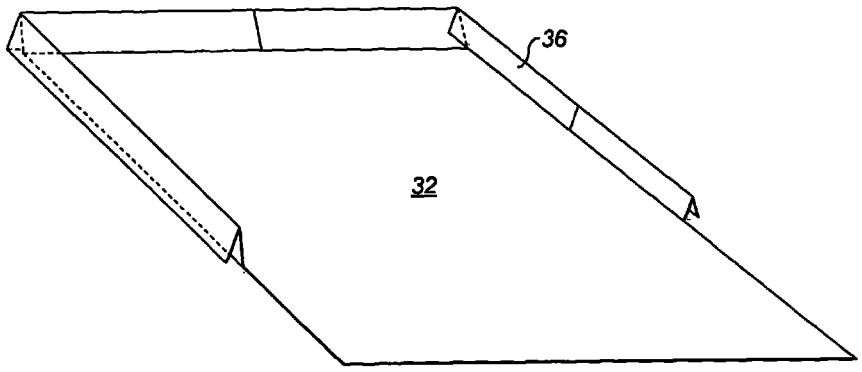
FIG. 5 is a perspective view of an area prepared for coating.

In FIG. 5, a prepared surface to be coated 32 is shown. Once the surface 32 has been cleaned and dried and the sand has been applied to the curb 35, screens 36 are erected at the borders of the surface 32 to prevent overspray of the surface coating onto the surrounding area. Ideally, the screens 36 are free-standing "A-boards" formed from PVC and of no less than 150 mm in height. The screens 36 are erected immediately outside the existing curb structure.

Figure 8:
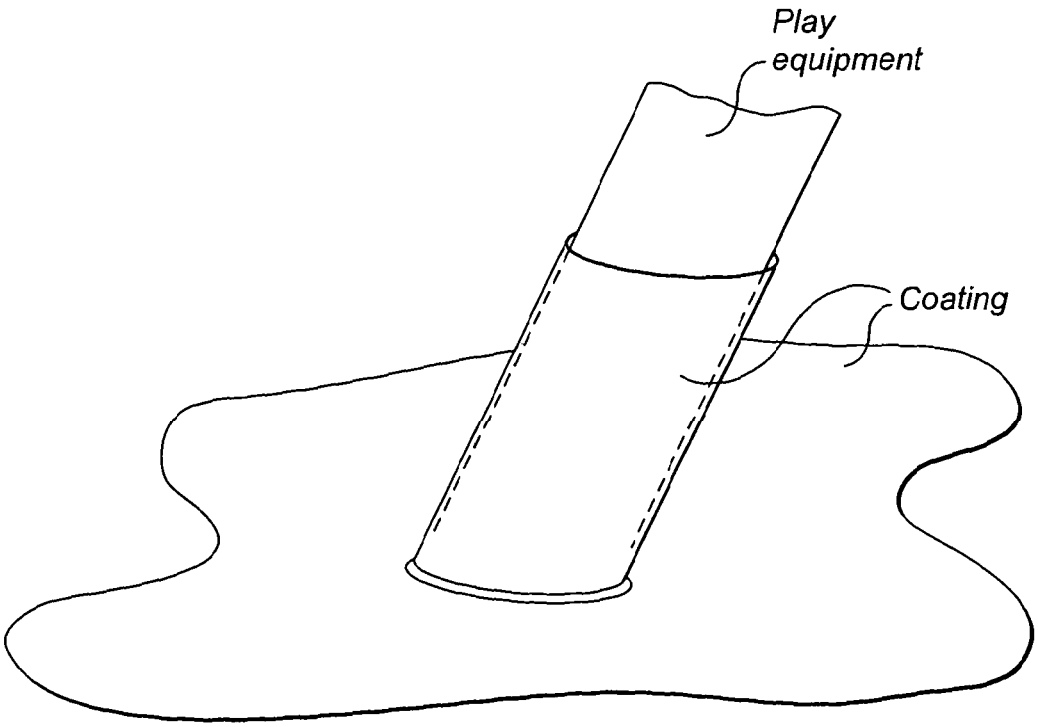
FIG. 8 illustrates a coating applied to a surface and part of an existing structure thereon.

If the surface 32 is in an existing play area, existing pieces of play equipment must be shielded from overspray. This can be achieved by wrapping at least part of the play equipment in shrink wrap. Nevertheless, preferably, approximately 100 mm of the lowermost parts of the equipment, particularly any part which is in contact with, or extends from, the surface 32, are left unprotected by shrink wrap and are thus exposed to the spray. This results in a protective layer of coating at the base of the equipment, as shown in FIG. 8. This ensures there are no gaps in the surface around the base of the existing structure which weeds could colonize.

Prior to the spraying of the surface coating, the first and second components of the binding agent are pumped by the transfer pumps 15 and the pumps 21 of the sprayer 10 out of the first and second containers 8, 9, through supply hoses 11 and into separate heater units within the heater 18. After passing through the heater units, the first and second components are returned to the respective containers 8, 9 through return hoses 12, thereby raising the temperature of the components in the containers 8, 9. This temperature rise reduces the viscosity of the component liquids and the curing time of the resulting polymer. The components of the binding agent are heated to approximately 70-80° C. The exact temperature to which each component is raised is dependent upon the nature of the component and the ambient conditions. The temperature of each component should be adjusted to ensure that the delivery is balanced. That is, the viscosity of each component should not be so different as to result in the delivery of unequal quantities of the two components. Ideally the Polyurea Hybrid Polyol component is heated to approximately 80° C. and the Polyurea Hybrid Isocyanate component heated to approximately 75° C. The delivery hose 14 is heated to a temperature corresponding to the lowest component temperature. Therefore, in this example, the delivery hose 14 is ideally heated to 75° C.

Once each of the components has reached the predetermined temperature, the sprayer 10 is set to "spray". This closes the circulation valves 22, preventing the liquid components from recirculating back to the containers 8, 9 and diverting the liquid components through the outlets 23 to separate hoses within the main delivery hose 14. The liquids are then pressurized to a predetermined level, the pressure level being predetermined by the user dependent on the delivery required from spray gun 13. This pressure can vary from 500 psi to 3500 psi. Preferably, the pressure is approximately 3250 psi.

In addition, the particulate media apparatus 24 is connected to a compressed air source and the hopper 25 is pressurized to approximately 125 psi. The flow rate and particulate media delivery is adjusted as required according to the delivery of the binding agent, which may vary for instance due to the dimensions of the nozzle of the spray gun 13.

Figure 6:
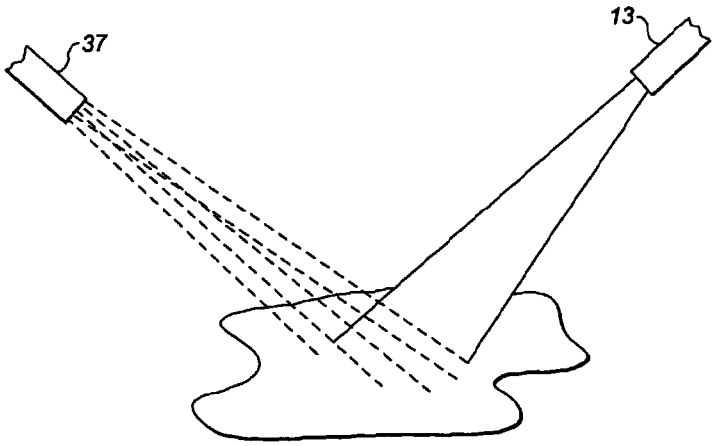
FIG. 6 is a schematic view of the application of a surface coating in accordance with the method of the present invention.
Figure 7:
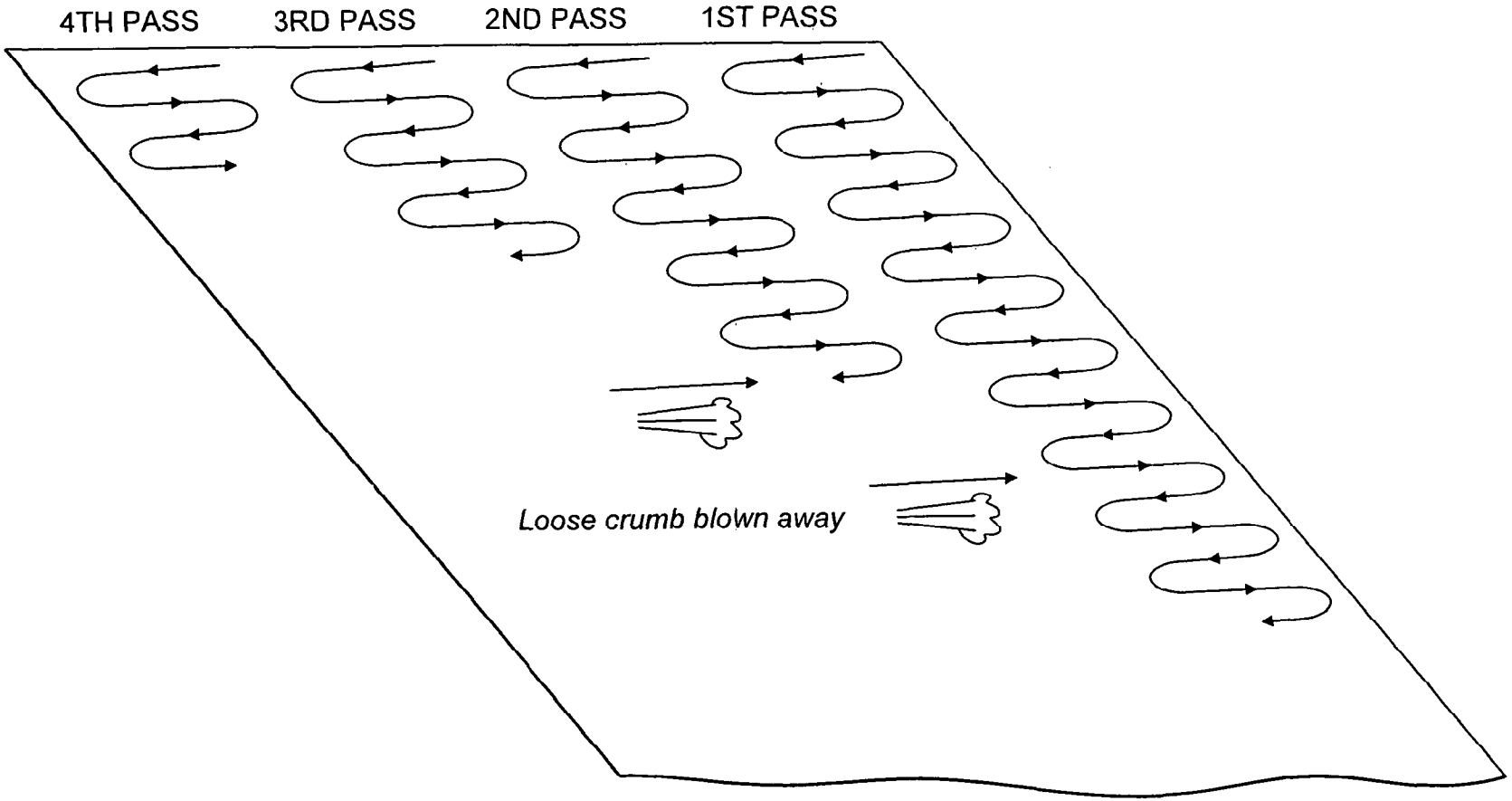
FIG. 7 is a schematic view illustrating further steps in the method of the present invention.

With reference to FIGS. 6 and 7, a method of applying the surface coating is shown. The spray gun 13 and blast nozzle 37 are directed toward the surface to be coated 32 and operated simultaneously, ideally by separate operators. Upon actuation of the spray gun 13, the first and second liquid components are combined in the mix chamber and exit the nozzle of the spray gun 13 in the form of a liquid spray. The nozzle of the spray gun 13 is held approximately 60 cm from the surface to be coated 32 and the liquid spray is applied to the surface to be coated 32 with a thickness of at least 1 mm. The thickness of the liquid spray applied is determined visually.

Simultaneously, the rubber crumb is expelled from the blast nozzle of the particulate media apparatus 24 toward the surface 32 in the region of the newly applied liquid spray. Preferably, the blast nozzle is held such that the rubber crumb is expelled at an angle of approximately 30-45° to the horizontal. The liquid binding agent is thus "bulked out" and coats the rubber crumb and lies on top as a surface layer. The liquid and particulate media sprays are applied in a number of generally wave-like, side-to-side motion passes, as depicted in FIG. 7. Each "wave" is approximately 1 m wide. Once the first pass has been completed, the coating is allowed to set, thus binding the rubber crumb into the polymer and adhering the polymer and rubber crumb to the surface 32. This occurs in approximately 60 seconds. Once set, the air lance 1 is employed to remove any loose particles on the surface 32. Following this, a second and further passes can be completed in much the same way. The air lance 1 is preferably used between each pass to prevent loose crumb from being oversprayed and thus causing a visible seam between adjacent passes.

After the final pass has been completed, the surface coating is allowed to cure. Loose rubber crumb is then removed, either by sweeping with a conventional broom, or by another known method, such as by use of a vacuum cleaner.

Figure 9:
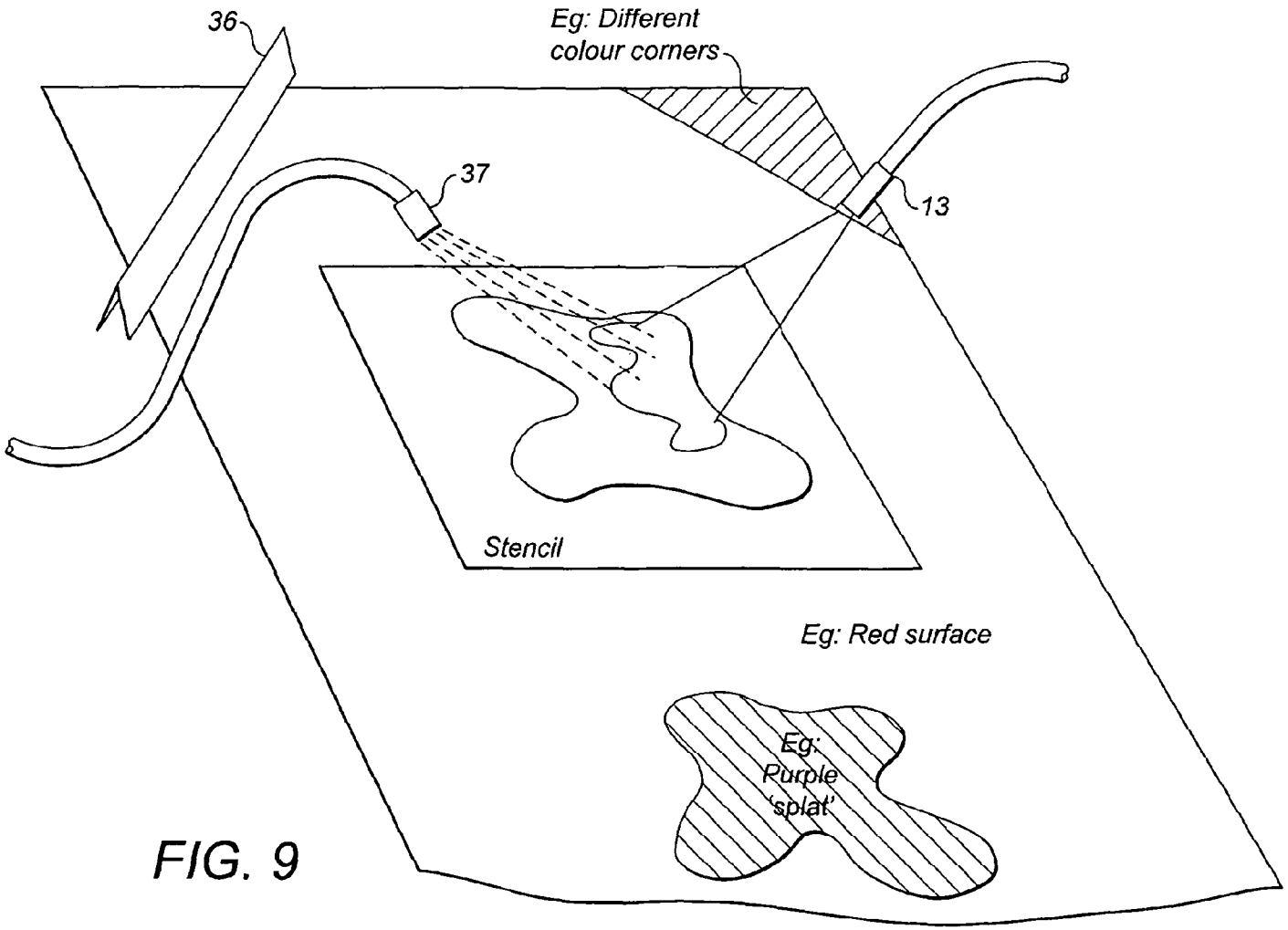
FIG. 9 illustrates use of the present invention to form colours colors and patterns on a coated surface.

If desired, color additives may be used in the surface coating to provide a different color surface in different areas. Stencils/masks may also be used to create patterns on the surface. Examples are shown in FIG. 9.

Thus a method and an apparatus are provided for applying a hard-wearing, weather-resistant, non-slip, shock-absorbing surface coating that is flexible, tough and completely adhered to the underlying surface and curb edging such that it is very difficult to remove and prevents the growth of weeds. The coating can be applied easily and quickly and cures extremely fast, increasing the efficiency of the procedure. It will be appreciated that various alterations and modifications to the precise details described are possible without departing from the scope of the claims.

For instance, although the binding agent has been described as comprising a two-part polyurea hybrid, other binding agents may be suitable, provided they may be applied in spray form and cure quickly to provide an elastomeric and tough coating which is resistant to impact, tearing and abrasion. Thus, other polymers may be suitable and may be provided in one-part, or other, form, rather than the two-part form described.

Although the embodiment described above relates to the application of a coating to the surface of a children's play area, the present invention is readily applicable to other uses, such as a surface coating on paths, bridges, steps, gymnasiums, swimming pools, running tracks, decks, in public or industrial buildings or in animal enclosures.

The invention claimed is:

1. A method for applying a coating to a surface, the method comprising:

providing a sprayable liquid binding agent formed of first and second components;

pumping the first and second components of the binding agent to a first dispensing device;

combining the first and second components in the first dispensing device to form the binding agent;

spraying the binding agent from the first dispensing device on to a surface to be coated;

providing a particulate medium and a second dispensing device therefor which is separate and spaced from the first dispensing device, wherein the particulate medium comprises rubber crumb, sand, and/or grit; and simultaneously with spraying the binding agent spraying the particulate medium under pressure from the second dispensing device at an angle approximately 30 degrees to 45 degrees from horizontal toward the surface in the region of the newly applied liquid spray of the binding agent such that the binding agent coats the particulate medium and adheres it to the surface to form a coating thereon.

2. A method as claimed in claim 1 further comprising heating each of the first and second components independently of the other to a temperature of 70-80° C.

3. A method as claimed in claim 1, wherein the binding agent is a polyurea, the first component is a polyurea hybrid polyol and the second component is a polyurea hybrid isocyanate.

4. A method as claimed in claim 1 comprising spraying the binding agent at a pressure in the range of 500-3500 psi (3.4-24.1 MPa).

5. A method as claimed in claim 1, wherein the particulate medium comprises rubber crumb.

6. A method as claimed in claim 1, wherein the particulate medium comprises particulates of between 0.5-5 mm in diameter.

7. A method as claimed in claim 1, further comprising applying pressurized, heated air to the surface to be coated to clean and dry the surface before spraying the binding agent and the particulate medium.

8. A method as claimed in claim 7, further comprising applying the coating in a wave-like manner to a first area to be coated, allowing the coating to cure, applying pressurized, heated air to the surface to be coated to remove loose particulates, and repeating the steps above to coat a second area adjacent to the first, and to coat subsequent areas thereafter.

9. A method as claimed in claim 1, further comprising arranging screens at the borders of the area to be coated.

10. A method as claimed in claim 1, further comprising shielding structures located in the area to be coated to prevent the coating adhering thereto, except for lowermost portions of the structures.

11. A method as claimed in claim 1, further comprising applying coatings of different colors to different areas of the surface to be coated.

12. A method as claimed in claim 1, further comprising using masks or stencils to apply coating to selected areas of the surface to be coated.

* * * * *